United States Patent [19]

DuBois

[11] Patent Number: 4,515,053

[45] Date of Patent: May 7, 1985

[54] CONTINUOUS WEB FEEDER WITH WEB CUTTING MEANS

[76] Inventor: R. Clark DuBois, 332 Wakeman Rd., Fairfield, Conn. 06430

[21] Appl. No.: 494,774

[22] Filed: May 16, 1983

[51] Int. Cl.[3] ..... B26D 1/18; B26D 1/20

[52] U.S. Cl. ..... 83/488; 83/508; 83/578; 83/614

[58] Field of Search ..... 83/484, 488, 487, 508, 83/614, 578

[56] References Cited

U.S. PATENT DOCUMENTS

| | | | |
|---|---|---|---|
| 469,837 | 3/1892 | Fulton | 83/484 X |
| 878,527 | 2/1908 | Heil | 83/488 X |
| 1,362,544 | 12/1920 | Smith . | |
| 1,643,583 | 9/1927 | Norin . | |
| 1,862,772 | 6/1932 | Smith . | |
| 2,241,142 | 5/1941 | Kualheim | 83/488 |
| 2,846,005 | 8/1958 | Wilson | 83/484 |
| 3,173,324 | 3/1965 | Pass | 83/488 |
| 3,181,406 | 5/1965 | Sayles | 83/488 X |
| 3,496,817 | 2/1970 | Staats et al. . | |
| 3,503,604 | 3/1970 | Martin et al. | 83/484 X |
| 3,686,991 | 8/1972 | Fujimoto . | |
| 3,712,164 | 1/1973 | Meschke et al. | 83/484 X |
| 3,733,951 | 5/1973 | Fujimoto . | |
| 4,011,811 | 3/1977 | Kodis . | |
| 4,086,835 | 5/1978 | Frederick | 83/484 |
| 4,192,618 | 3/1980 | Kondur, Jr. et al. . | |
| 4,234,261 | 11/1980 | Hendrischk et al. . | |

*Primary Examiner*—Frank T. Yost

[57] ABSTRACT

A continuous web feeder for printers and the like includes side frames, drive and support shafts for the feed tractors, and a cutter wheel movable between the side frames and rotatable as it moves therebetween to cut the web. A drive unit includes an electric motor to effect to transverse and rotary motion, and control means actuated by operation of the printer to actuate the motor for movement of the cutter from one side frame to the other and to change the direction of rotation of the motor at each cycle and thereby the direction of movement of the cutter wheel. In its preferred form, the drive means includes winch and cord means engaged with the cutting wheel and its support to effect the transverse and rotary motion, and the control means includes an actuator operated by the motor to effect operation of switches.

15 Claims, 9 Drawing Figures

CONTINUOUS WEB FEEDER WITH WEB CUTTING MEANS

BACKGROUND OF THE INVENTION

Many typewriters and printers are adapted to the use of continuous rolls of paper or to fan-fold paper and frequently use printer attachments providing tractor-like mechanisms for advancing the continuous paper about the platen of the typewriter or printer, or exiting from the platen. With the increasing use of high speed printing devices and memory typewriters, there has been growing demand for low cost apparatus which would enable the use of such typewriters and printers with continuous paper that could be severed along its length to provide individual sheets of predetermined size. Many such devices have been proposed and a number have been utilized in connection with printing apparatus. However, much of the apparatus heretofore available has been cumbersome in size, or relatively high priced, or unduly limited in speed of operation, or relatively sensitive to operating conditions.

It is an object of the present invention to provide a novel continuous web feeder attachment for printers and the like which is adapted for various types of printers and typewriters and which may be readily assembled thereto and disassembled therefrom.

It is also an object to provide such an attachment which may be fabricated at relatively low cost from relatively durable or readily replaceable parts so as to provide effective and relatively trouble-free operation.

Another object is to provide such an attachment which is controlled by movement of the normal platen of the printer or typewriter and which will effect severing of the paper in either direction of movement of the cutting element across the attachment.

Still another object is to provide such an attachment utilizing a novel control means enabling precise cutting action in either direction of movement of the cutting element across the attachment.

SUMMARY OF THE INVENTION

It has now been found that the foregoing and related objects can be attained in a web feeder attachment for printers and the like wherein there is provided a housing with side frames, a drive shaft extending transversely of the housing and mounted for rotation therein, and a support shaft extending transversely of the housing and mounted in the side frames. The drive and support shafts are adapted to support paper feed means for advancing paper or the like through the feeder. A cutter assembly is supported on the housing and includes a cutter wheel, means mounting the cutter wheel in the cutter assembly for rotation about an axis generally perpendicular to the drive and support shafts and for movement transversely of the housing between stop positions adjacent the side frames.

Drive means is provided for effecting movement of the cutter wheel between the stop positions, and includes a reversible drive electric motor, and means for effecting rotation of the cutter wheel about its rotational axis during its movement between the stop positions. Control means includes first switch means adapted to be actuated by a predetermined motion of the platen of the associated printer to actuate the electric motor, means to terminate motor operation upon movement of the cutter wheel from one stop position to the other stop position, as well as means for changing the direction of rotation of the motor upon movement of the cutter wheel from one stop position to the other stop position. The cutter is adapted to cut the web in either direction of movement between the side frames.

In the preferred embodiment, the cutter wheel mounting means includes slider means and guide means for the slider means, and the cutter assembly drive means includes a winch driven by the motor and cord means engaged with the winch and the slider means. As a result, rotation of the winch will effect movement of the slider means across the web. Desirably, the cutter wheel rotation means includes a winch rotatably supported on the slider and engaged with the cutter blade to effect rotation thereof, a cord engaged about the winch and extending to the side frames so that movement of the slider causes the winch to rotate the cutter blade. The guide means extends between the the side frames and the slider means is slidable in a channel in the guide means. The ends of the cord means are engaged with the slider means, and the cord means also extends from the slider means and about a sheave on the the side frame opposite that having the winch.

Desirably, the several operating means of the control means comprise switches, and the motor direction changing means is a switch changing the direction of polarity of the poles of the motor. As a result, the control means effects operation of the direction changing switch at each cycle of operation. The control means includes a switch actuator operated by the motor and actuating the second switch means to terminate operation of the motor upon movement of the cutter wheel from one to the other stop position and to alter the direction of rotation of the means for changing the direction of rotation of the motor. Conveniently, the direction changing means is a double pole switch which changes the polarity of the poles of the motor, and the switch actuator has actuating surfaces thereon engageable with the second switch means to terminate operation of the motor and engageable with the double pole switch to alter the contacted pole of the double pole switch.

DETAILED DESCRIPTION OF THE ILLUSTRATED EMBODIMENTS

Figure 1:
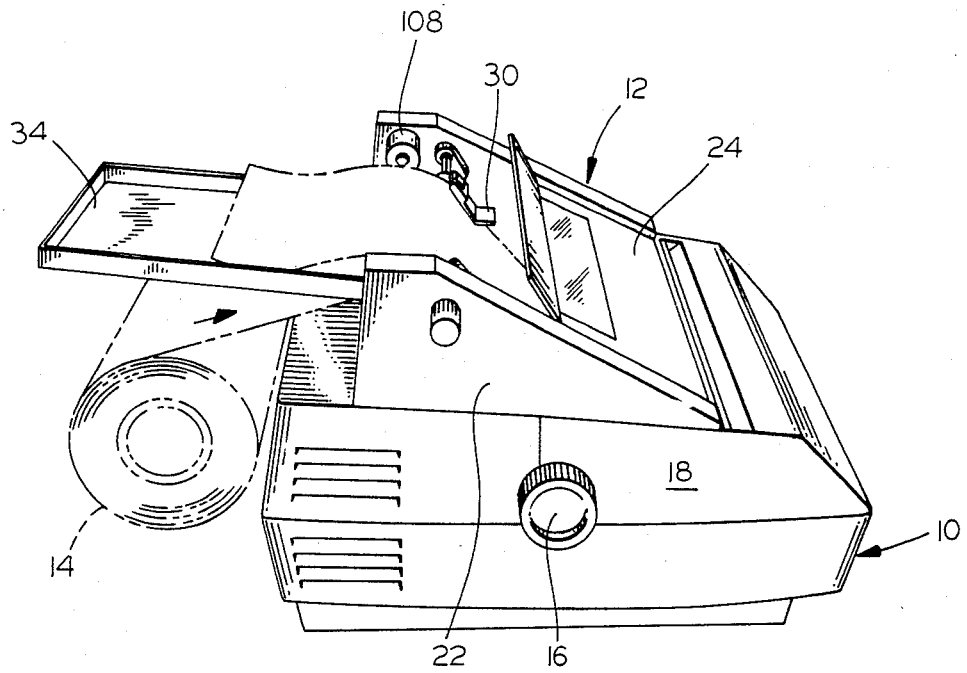
FIG. 1 is a perspective view of a printer upon which has been mounted a roll feeder attachment embodying the present invention and showing in phantom line a roll of paper extending therethrough but omitting the roll support assembly.
Figure 2:
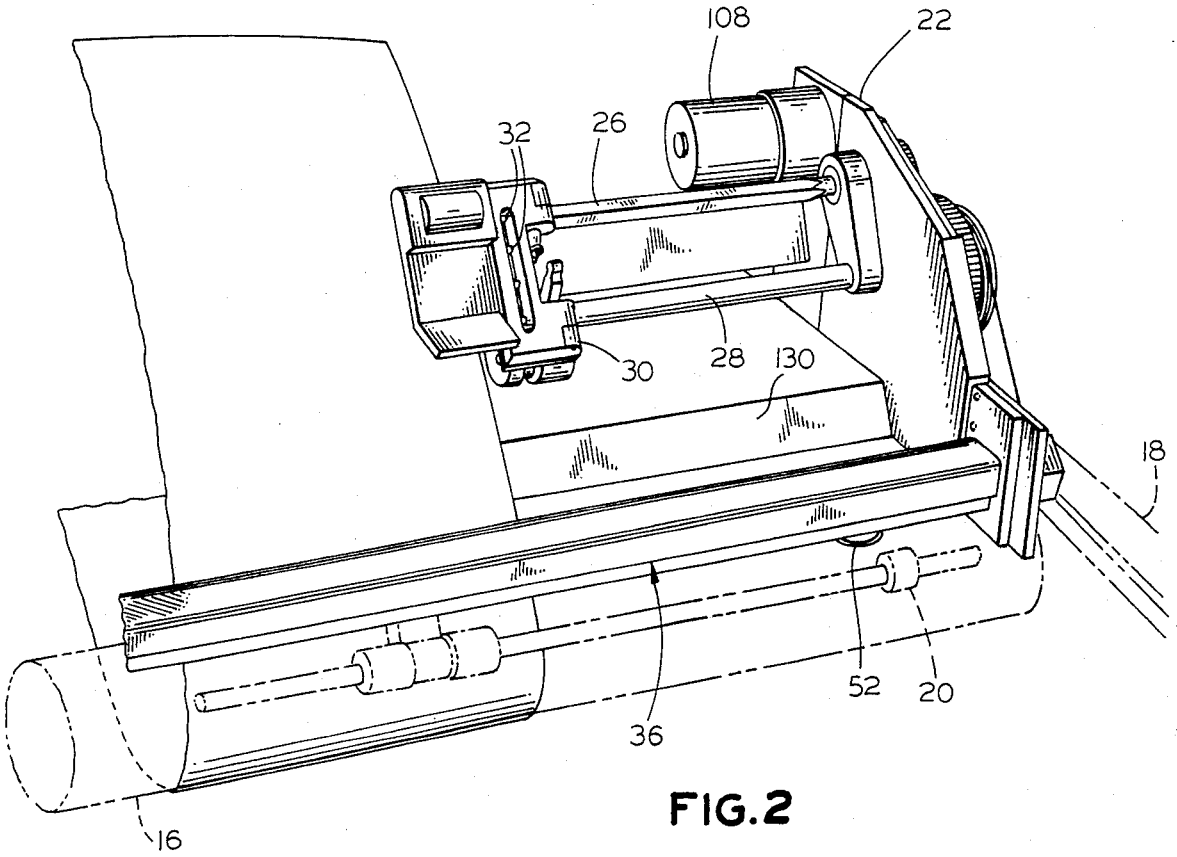
FIG. 2 is a fragmentary perspective view of the attachment and a portion of the printer with the front cover removed so as to reveal internal construction and showing fragmentarily the paper web as supported thereon.

Turning first to FIGS. 1 and 2, therein illustrated is a printer generally designated by the numeral 10 upon which is mounted a continuous web feeder attachment embodying the present invention and generally designated by the numeral 12. Shown in phantom line is a roll of paper 14 which is rotatably supported on a roll support assembly (not shown). In accordance with conventional practice, the printer 10 has a platen 16 rotatably mounted in the printer frame 18 and about which the web of paper 14 extends. The platen 16 is adapted to advance paper or the like therethrough by frictional contact in one mode of operation of the printer 10. The bail 20, which is shown in phantom line in FIG. 2, may be removed, or be pivoted into inoperative position, when the attachment of the present invention is employed.

The attachment 12 is comprised of a housing which includes the side frames 22. In this printer embodiment, the front cover 24 is pivotably supported upon the printer 10; alternatively, the housing of the attachment 12 may have a cover pivotably supported between the frames 22. In accordance with conventional practice, the attachment 12 includes a drive shaft 26 supported for rotation in the side frames 22, and a support shaft 28 supported in the side frames 22 in spaced, parallel relationship to the drive shaft 26. For use with the imperforate paper of the roll 14, a pair of combination friction/-pin drive tractors 30 are mounted on the shafts 26, 28 and will effect movement of the paper 14 therethrough from the platen 16 as the drive shaft 26 is rotated. For perforated paper, such tractors utilize the pins 32 on the drive belts, which pins extend through the perforations along the side margins of the paper and effect driving engagement therewith. Also supported on the roll support mechanism (not shown) between the rear portion of the side frames 22 is a paper receiving tray 34 to receive the severed sheets discharged from the tractors 30.

FIGS. 1 and 2 show the roll of paper 14 leading into the printer 10, going about the platen 16, and coming out through the tractor/roller assembly 30 into the receiving tray 34. As also seen in greater detail in FIG. 2, in this paper path the web of paper 14 extends around the platen 16, between the guide rails 42 of the knife assembly generally designated by the numeral 36, and then into the tractor assembly 30.

Figure 3:
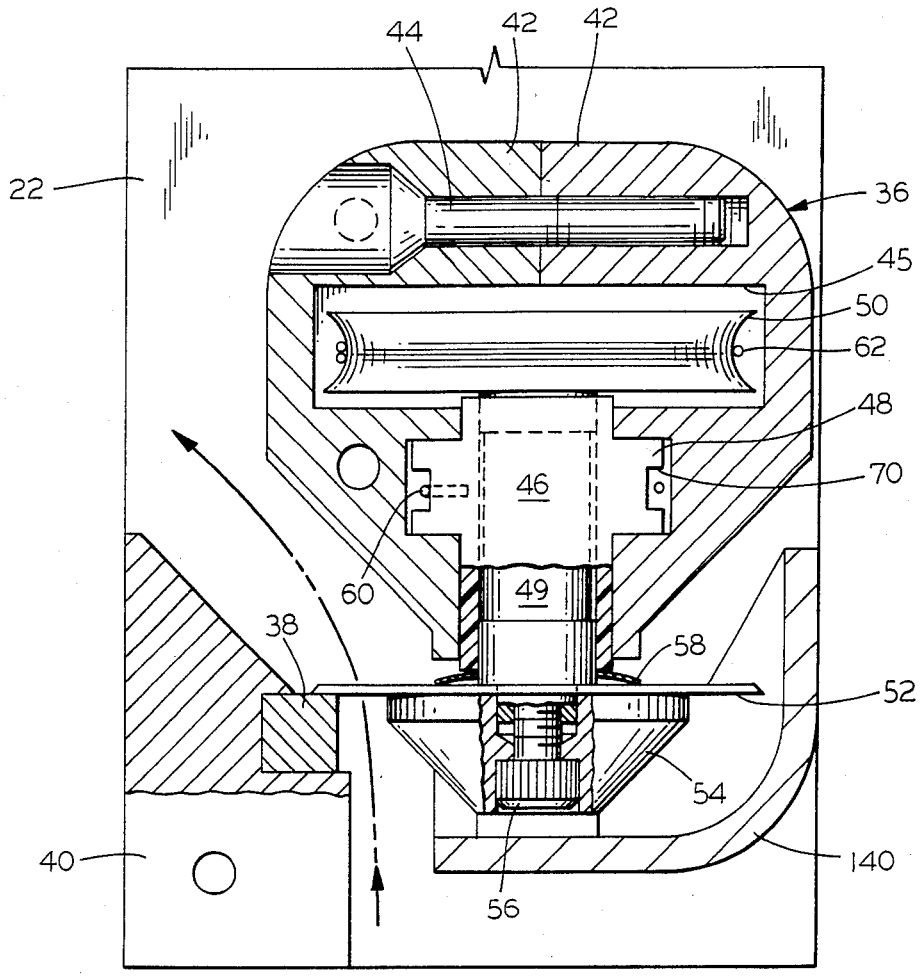
FIG. 3 is a transverse view of the cutter assembly drawn to an enlarged scale and with portions of the assembly in section to reveal internal construction.
Figure 4:
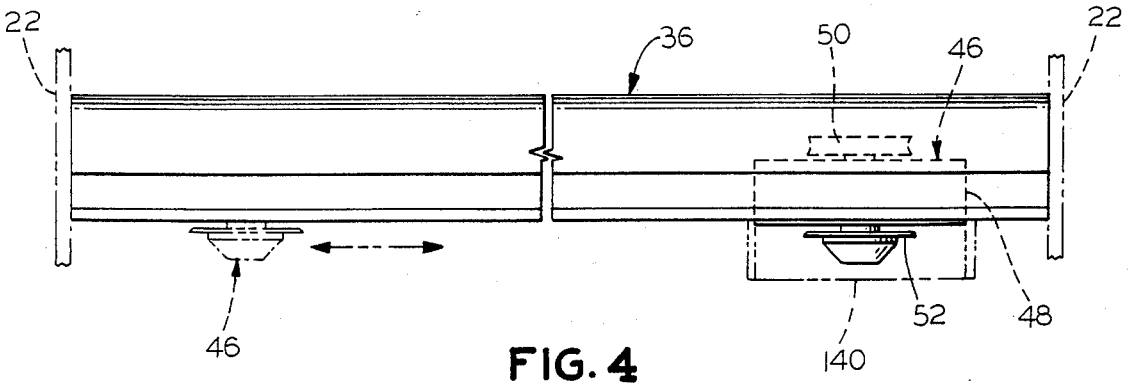
FIG. 4 is a fragmentary front elevational view of the cutter assembly and showing the rotary blade in an alternate position in phantom line.

Turning now to FIGS. 3 and 4, the rigid cutting bar 38 is mounted in a channel in the support bar 40 which is attached at its ends to the side frames 22. The guide rail 42 is assembled from two components and is rigidly connected by screws 44 and attached at its end to the side frames 22. Slidably supported in a channel 45 of the guide rail 42 is the movable knife assembly generally designated by the numeral 46.

The assembly 46 comprises a slider 48, a shaft 49, a winch head 50 fixed to the shaft 49, and a rotary cutting blade 52 which is secured on the other end of the shaft 49 by washer 54 and locking screw 56. A spring washer 58 is used to push the rotary cutting blade 52 onto the fixed cutting bar 38 to obtain proper cutting action.

Figure 7:
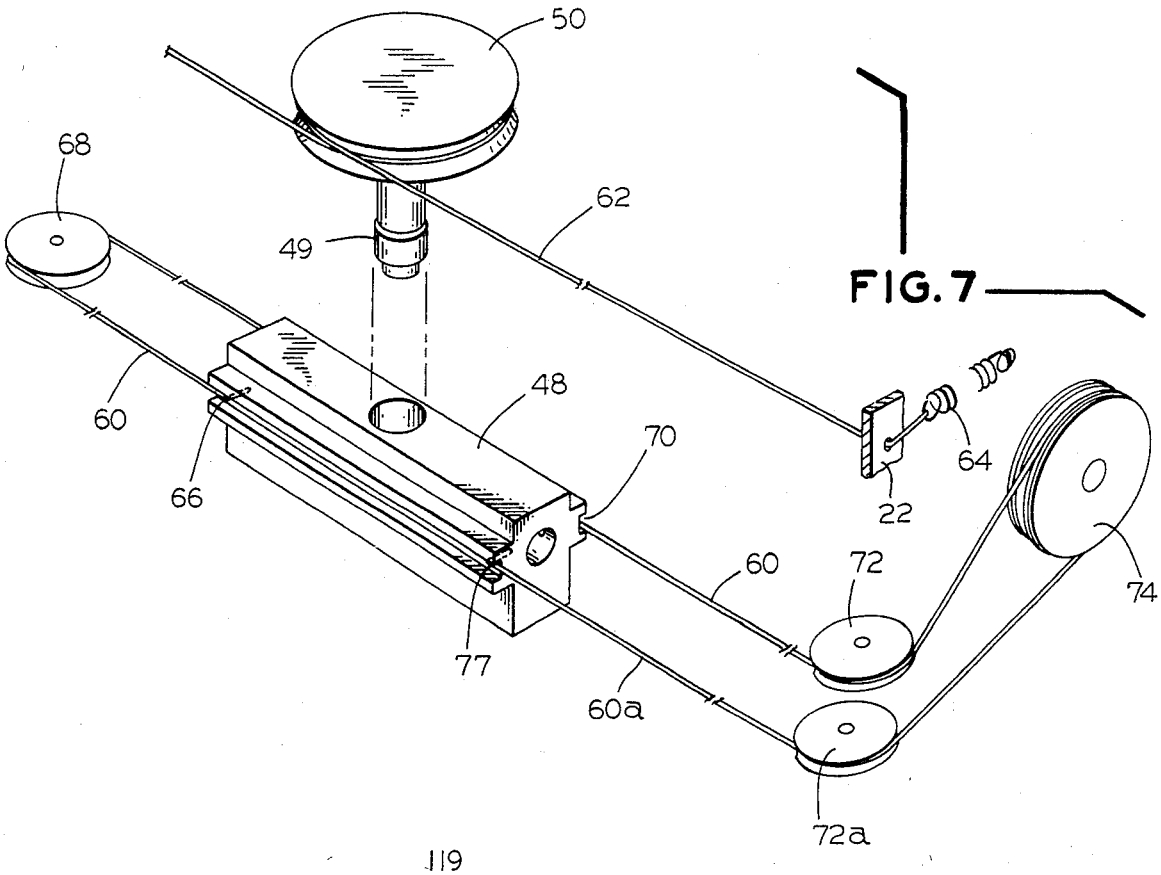
FIG. 7 is a partially diagrammatic perspective view of the slider, rotary blade drive winch, sheaves, slider winch drum and drive cords.

The movable knife assembly 46 is translated across the web of paper 14 by the cords 60 and 60*a* which are secured at their ends to the slider 48 as seen in FIG. 7. A separate winch rotation cord 62 has one full turn around the winch head 50. As shown diagramatically in FIG. 7, this cord 62 has one end secured in the left side frame 22, is looped around the winch head 50, and comes through the other side frame 22 where it is secured at its other to the tensioning spring 64 also shown in FIG. 5.

Figure 5:
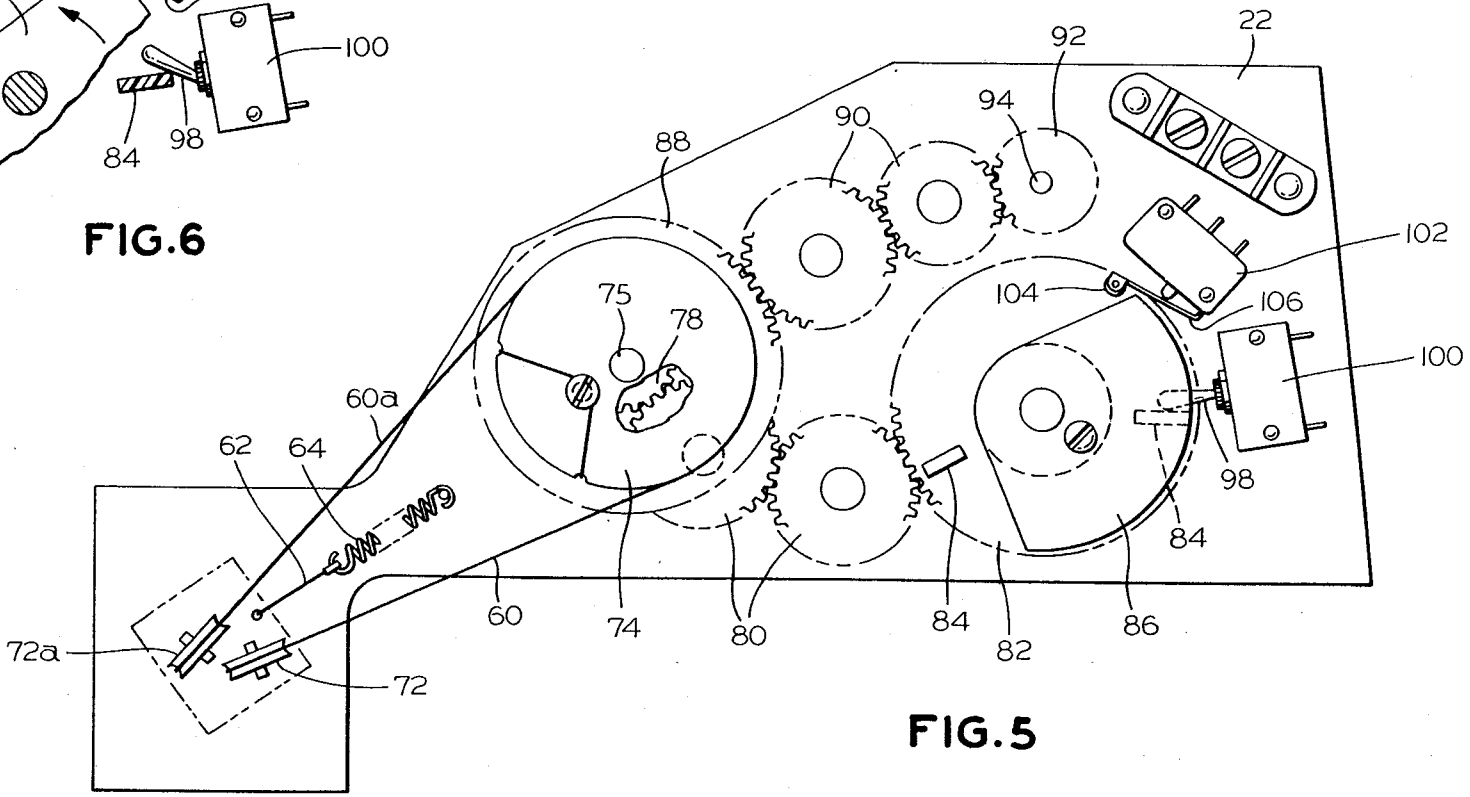
FIG. 5 is a partially diagrammatic side elevational view of the attachment showing the various gears and switches.

As previously indicated and as seen in FIG. 7, the cord 60 used to translate the movable knife assembly 46 is secured at one end to the slider 48 as indicated by the numeral 66. As also shown in FIG. 7, it goes to the left around an idler sheave 68 supported on the side frame 22 and behind the slider in the groove 70. As seen in FIG. 5, the cord 60 also passes about a turning sheave 72 and to the winch drum 74 where it makes several turns and is secured.

Also secured to the slider 48 at the point 77 is one end of the cord 60*a* which in a similar manner is led about sheave 72*a* to winch drum 74 about which it makes several turns before being secured thereto. The winch drum 74 has approximately six turns of a helical groove in its circumferential surface to guide the cords 60, 60*a* and to prevent chafing.

As seen in FIG. 5, the winch drum 74 rotates about a fixed post 75 and turns an integral small gear 78 which is connected through idler gears 80 to the large gear 82. On the outer face of the gear 82 are the switch actuator stops 84 and the cam 86. Also connected to the winch drum 74 by the integral large gear 88 and idler gears 90, is the motor gear 92 mounted on the motor shaft 94.

Rotation of the motor 108 causes the winch drum 74 to revolve through the drive train provided by the gears 92, 90 and 88. Through the action of cords 60 and 60*a*, the winch drum 74 causes the movable knife assembly 46 to move along the guide rail 42, and it also causes the gear 82 to rotate through the gears 78 and 80. As a result, the stops 84 and cam 86 rotate.

Figure 6:
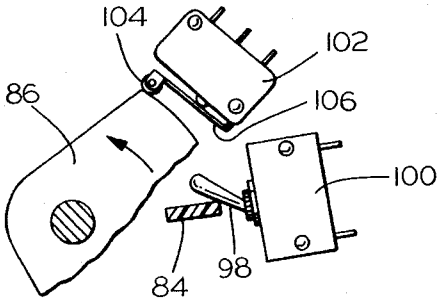
FIG. 6 is a fragmentary sectional view of the operating cam and stops and the switches.

Turning now to FIG. 6, one of the stops 84 is shown in its home position wherein it has operated the lever 98 of the double pole, double throw toggle switch 100. It also shows one corner of the cam 86 as having operated the switch 102.

When a signal is given for the attachment 12 to operate the cutter assembly, the electric motor 108 rotates the shaft 94 and this in turn causes the stops 84 and cam 86 to rotate in a direction opposite the arrow of FIG. 6. The movable knife assembly 46 then traverses across the paper web 14 from one side frame 22 causing a cut and it stops at the opposite side frame 22 when the other corner of cam 86 actuates the roller 104 on arm 106 of switch 102. At about the same time, the other of the two stops 84 will contact the lever 98 of toggle switch 100, and the coasting of the motor 108 will flip the lever 98 of the toggle switch 102 to the opposite side or other position, closing the alternate contacts as will be described more fully hereinafter. This sets up the logic circuit so that, on the next signal to cut, the knife assembly 46 moves in the opposite direction.

Figure 8:
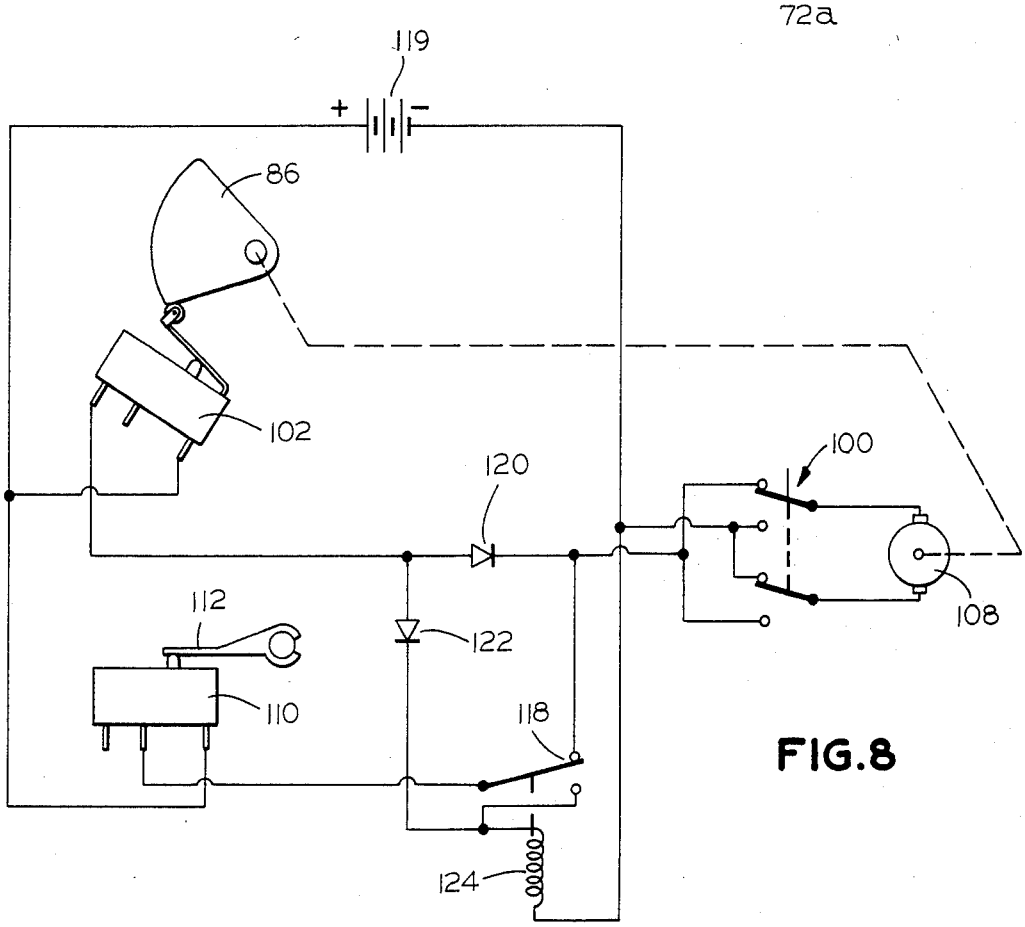
FIG. 8 is a schematic diagram indicating the operational circuitry for the attachment.

Referring now to FIG. 8, this schematic shows the toggle switch 100 connected to the motor 108 which drives the winch drum 74 and the various gears of FIG. 5 and the cam 86 and stops 84. As previously described, stops 84 flip the toggle switch 100 from one position to the other to change the direction of polarity of the current supplied to the motor 108 and determine whether it will next run in the clockwise or counterclockwise direction.

Figure 9:
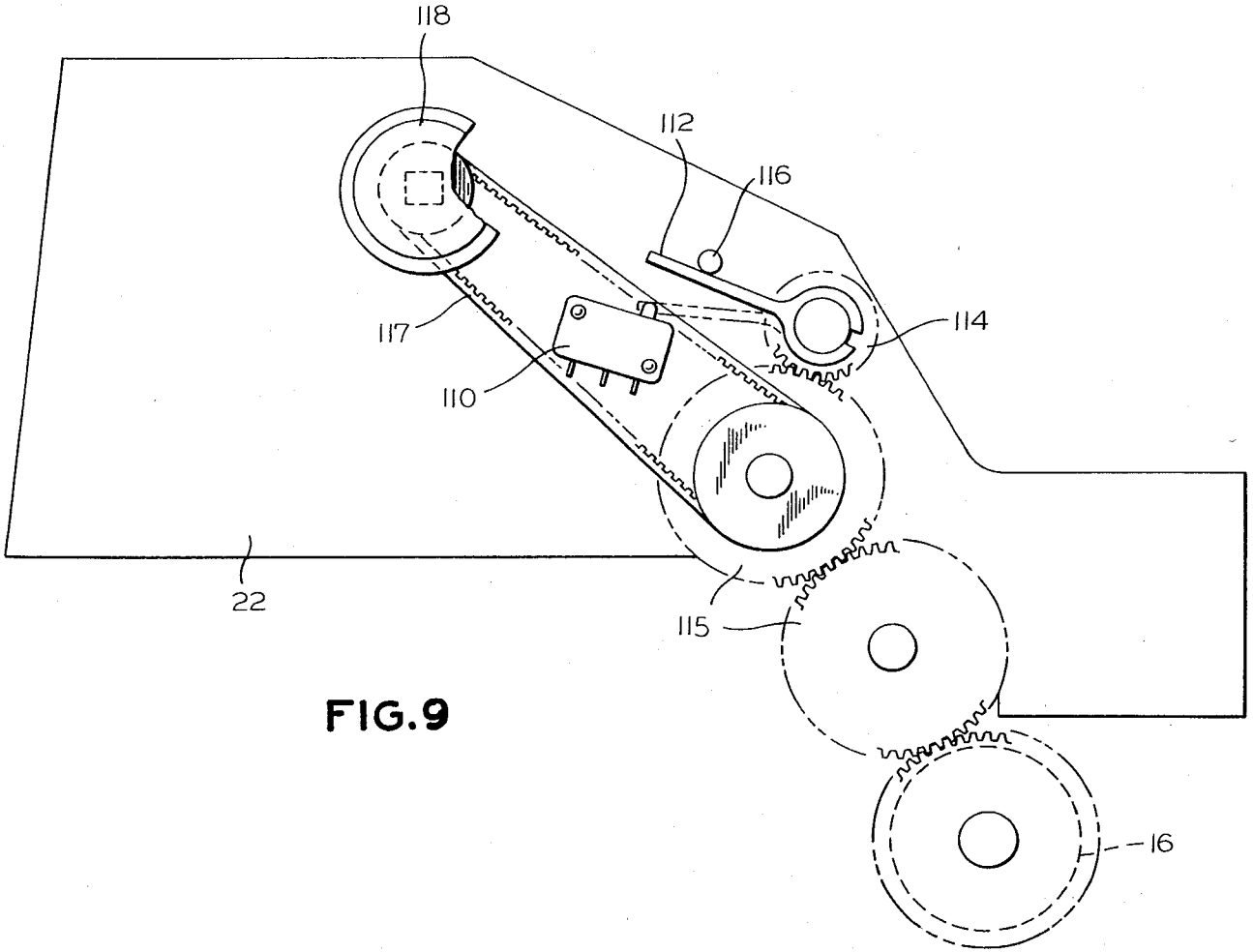
FIG. 9 is a side elevational view of the attachment as engaged with the platen gear of the printer.

Referring to FIG. 9, therein can be seen the arm 112 and the cut signal switch 110 which is activated thereby. The arm 112 is frictionally coupled with gear 114 and thereby to a gear train 115 connected to the platen 16. The arrow on the platen 16 shows the normal feed direction of the platen 16 which will rotate the arm 112 against the stop 116. Further rotation of the platen 16 in the direction of rotation indicated by the arrow will cause the arm 112 to slip relative to the gear hub 114. When there is a reversal of the normal direction of rotation of the platen 16, this will turn the arm 112 toward the switch 110 where it will actuate the switch 110 and then slip on the hub of gear 114 during additional reverse motion. Typically, the free motion of the arm 112 to actuate the switch 110 comprises about two lines of reverse platen travel.

When switch 110 is operated by arm 112 after a reversal of the platen 16, the printer is stopped for approximately 7 seconds while the rotary knife 46 is severing the paper web 14. During this time, friction, vibration, and play in the gear teeth may cause arm 112 to move slightly away from switch 110 so that the status of the switch 110 is unclear after the cut is initiated as will be discussed more fully hereinafter.

Also shown in FIG. 9 is a toothed belt 117 driving the tractor drive shaft 26 which in turn drives the tractors 30.

Referring again to the circuit of FIG. 8, when the switch 110 is actuated because the arm 112 is rotated counterclockwise due to a reverse motion of a platen, this connects the positive side of the power supply 119 through the relay contact 118 to the toggle switch 110 and the motor 108. As the motor 108 starts to turn and the knife assembly 46 moves, the cam 86 moves in a clockwise direction and, after a slight motion, switch 102 is turned on. Current flows through diode 120 to continue the motion of the motor 108 and through the diode 122 to operate relay coil 124. The operation of the relay coil 124 breaks the relay contact at 118. The motor 108 continues to run because of the current flowing through diode 120 until the home position at the other side frame 22 is reached, at which point the other corner of cam 86 opens switch 102. As previously described, at about the same time as switch 102 is opened, the toggle switch 100 is flipped to its other stable position setting up the motor to run in the opposite direction the next time it is actuated.

During this cutting action, the switch 110 is normally closed because the printer has not moved from its last motion which was in the reverse direction. In this case, the relay coil 124 is still powered through the switch 110 which keeps the contact 118 open. It is necessary to have diode 122 to block flow of the current through switch 110 and operation of the motor 108 through this path. After the cut, the printer 10 advances the paper 14 which will turn the arm 112 in a clockwise direction and open the switch 110, which will remove the current from relay coil 124, and the relay spring will move its contact into the position shown, closing the circuit at 118 and preparing the system for the next operation.

Diode 120 is necessary so that, at the initial operation of switch 110, current cannot flow backwards through the diode 120 and then down through diode 122 to operate the relay coil 124.

As previously mentioned, during the cutting operation arm 112 may leave switch 110 but this will not adversely effect the operation of the system because the motor 108 will be powered until the cam 86 reaches its home position and opens the switch 102.

The following is a stepwise description of the operation of the control circuit.

| | SWITCH CONDITION | | | |
|---|---|---|---|---|
| Step | 110 | 102 | 100 | ACTION |
| 1 | 0* | 0 | CW | Start position, one of the two home position. |
| 2 | 1 | 0 | CW | Printer platen has reversed and stopped. Knife motor starts in the CW direction. |
| 3 | 1 or 0 | 1 | CW | Knife motor runs until the knife is at the other side of the web of paper. 110 may be in its 0 (off) position due to system vibration or backlash. |
| 4 | 1 or 0 | 0 | CW | Knife stops at the other home position. 100 is toggled to the CCW position. This is the second home position. |
| 5 | 0 | 0 | CCW | Printer advances paper. 110 is turned off if it was on. |
| 6 | 1 | 0 | CCW | Repeat from step 2. Knife moves in the other direction. |

*0 = no contact; 1 = contact
[CW = clockwise direction; CCW = counterclockwise direction]

Step 2 and Step 4 can be the same, but the motor runs in the first case, and does not in the second. Thus, it can be seen that this circuit accomplishes a number of control functions with a few parts.

The speed of rotation of the rotary cutting blade 52 in relation to the translational velocity of the movable knife assembly 46 across the apparatus 12 is critical. If it is not rotated fast enough, it wil tend to push the paper 14 ahead of the moving knife assembly 46. If it is going too fast, it will pull the paper 14. Control of the speed is effected by proper relationship between the diameter of the winch drum 50 in cooperation with the rotation cord 62, the diameter of the rotary cutting blade 52, and the overlap of the blade 52 relative to the fixed cutting bar 38. Basically, the radius from the rotational center of the rotary cutting blade 52 to the near edge of the fixed cutting bar 38 should be substantially the same as the radius from the rotational center of the shaft 49 to the center line of rotational cord 62. If this geometric relationship is followed, the combination of the translational velocity and the component of the edge velocity of rotary cutting blade 52 in the direction of translation will be exactly the same but in opposite directions so that the paper 14 sees a knife blade 52 sliding across the fixed cutting bar 38 with only a velocity toward the bar 38. Any tendency to slide the paper web to the right or left is thereby eliminated.

It has been found desirable to have the winch drum 74 make approximately three revolutions to transport the knife 52 across the paper web 14. The small gear 78 which is connected to the idler gears 80 and to the large gear 82 drives the cam 86 and stops 84. The several gears are cooperatively dimensioned and provided with gear ratios so that the gear 82 makes less than one revolution during the knife cut (a traverse from one stop position to the other). As shown in FIG. 5, the rotation of the gear 82 is approximately 200° for the full travel of the movable knife assembly 46.

After the paper 14 has been severed at the cutting bar 38, the leading edge of the cut web is guided upwardly by the guide surface 130 and into the throat of the tractors 30. Desirably, the frames of the tractors 30 have a guide element (not shown) extending towards the guide surface 130 and under the web 14. The normal curl of the web 14 will cause it to bear against such surfaces.

Although the attachments of the present invention have principal application to imperforate roll paper or the like, they may be adapted to use with webs provided with perforations along the side edges which engage with the projecting pins of drive tractors. In such an application, the attachment may have a pair of drive and support shafts to carry two pairs of tractors, one pair to feed the web into the printer and another to feed the severed length to the tray. Alternatively, the assembly may use the platen of the printer to advance the web to the cutter assembly.

It will be appreciated that the switches, relays and actuators of the illustrated embodiment provide a low cost, trouble-free control circuit. However, it so desired, solid state devices and microprocessor logic may be employed to control the several functions.

The assembly preferably uses a guard such as designated by the numeral 140 in FIG. 3 to cover the ortary cutting blade. In other configurations of carriers, the guard may be included as a part of the rails.

The term "continuous web feeder" as used herein encompasses both webs of material such as paper and the like from a roll or from a fan-fold stack on the like.

The term "cord" as used herein encompass fibrous cord, wire, filament, metal or plastic bands, cable, composite and other elongate flexible materials.

From the foregoing detailed specification and claims, it can be seen that the continuous web feeder attachment of the present invention is readily adapted to various printers and typewriters and may be readily assembled thereto and disassembled therefrom. It may be fabricated at relatively low cost from relatively durable or easily replaceable parts to provide long lived operation, and it is easily controlled by operation of the platen. Moreover, the cutter will sever the web in either direction of translational movement, and the attachment uses simple but highly effective control circuit elements.

Having thus described the invention, I claim:

1. In a continuous web feeder attachment for printers and the like, the combination comprising:

A. a housing including side frames;

B. a drive shaft extending transversely of said housing and mounted for rotation in said side frames;

C. a support shaft extending transversely of said housing and mounted in said side frames, said drive and support shafts being adapted to support paper feed means for advancing paper or the like through said feeder;

D. a cutter assembly supported on said housing and including a cutter wheel, means mounting said cutter wheel in said cutter assembly for rotation about an axis generally perpendicular to said drive and support shafts and for movement transversely of said housing between stop positions adjacent said side frames, said cutter wheel mounting means including slider means and guide means for said slider means;

E. drive means for effecting movement of said cutter assembly between said stop positions, said drive means including a reversible drive electric motor, said drive means also including means for effecting rotation of said cutter wheel about its rotational axis during its movement between said stop positions, said cutter assembly drive means including a winch driven by said motor and drive cord means engaged with said winch and said slider means, whereby rotation of said winch will effect movement of said slider means, said cutter wheel rotation means including a second winch rotatably supported on said slider and engaged with said cutter blade to effect rotation thereof, a cutter rotating cord engaged about said second winch and extending to said side frames whereby movement of said slider causes said second winch to rotate said cutter blade; and F. control means including means adapted to be actuated by a predetermined motion of the platen of the associated printer to actuate said electric motor, means to terminate motor operation upon movement of the cutter assembly from one stop position to the other stop position, and means for changing the direction of rotation of said motor upon movement of said cutter assembly from one stop position to the other stop position, said cutter wheel being adapted to cut the web in either direction of movement of said cutter assembly between said side frames.

2. The web feeder attachment of claim 1 wherein said guide means extends between said side frames and said slider means is slidable in a channel in said guide means.

3. The web feeder attachment of claim 1 wherein the ends of said drive cord means are engaged with said slider means, and wherein said drive cord means also extends from said slider means and about a sheave on the side frame opposite that having said winch.

4. The web feeder attachment of claim 1 wherein said motor direction changing means is a switch changing the direction of polarity of the poles of said motor and wherein said control means effects operation of said direction changing switch at each cycle of operation.

5. The web feeder attachment of claim 1 wherein said control means includes a switch actuator operated by said motor and actuating said second switch mens to terminate operation of said motor upon movement of said cutter wheel to the other stop position and to alter the direction of rotation of said means for changing the direction of rotation of said motor.

6. The web feeder attachment of claim 5 wherein said direction changing means is a double pole switch which changes the polarity of the poles of said motor.

7. The web feeder attachment of claim 5 wherein said switch actuator has actuating surfaces thereon engageable with said second switch means to terminate operation of said motor and engageable with said double pole switch to alter the contacted pole of said double pole switch.

8. In a continuous web feeder attachment for printers and the like, the combination comprising:

A. a housing including side frames;

B. a drive shaft extending transversely of said housing and mounted for rotation in said side frames;

C. a support shaft extending transversely of said housing and mounted in said side frames, said drive and support shafts being adapted to support paper feed means for advancing paper or the like through said feeder;

D. a cutter assembly supported on said housing and including a cutter wheel, slider means mounting said cutter wheel in said cutter assembly for rotation about an axis generally perpendicular to said drive and support shafts and for movement transversely of said housing between stop positions adjacent said side frames;

E. drive means for effecting movement of said cutter assembly between said stop positions, said drive means including an electric motor, a winch driven by said motor, and drive cord means engaged with said slider means whereby rotation of said winch will effect movement of said slider means, guide means for said slider means, said cutter assembly also including means for effecting rotation of said cutter wheel about its rotational axis during its movement between said stop positions, said cutter wheel rotation means including a second winch rotatably supported on said slider and engaged with said cutter blade and a cutter rotating cord engaged about said winch and extending to said side frames whereby movement of said slider causes said second winch to rotate; and F. control means including means adapted to be actuated by a predetermined motion of the platen of the associated printer to actuate said electric motor and means to terminate motor operation upon movement of the cutter assembly from one stop position to the other stop position, and means for changing the direction of said motor driving said winch upon movement of said cutter wheel from one stop position to the other stop position, said cutter wheel being adapted to cut the web in either direction of movement of said cutter assembly between said side frames.

9. The web feeder attachment of claim 8 wherein said guide means extends between said side frames and said slider means is slidable in a channel in said guide means.

10. The web feeder attachment of claim 8 wherein the ends of said drive cord means are engaged with said slider means, and wherein said drive cord means also extends from said slider means and about a sheave on the side frame opposite that having said winch.

11. The web feeder attachment of claim 8 wherein said cutter wheel rotation means wherein the ends of said cutter rotating cord are engaged with said slider means, and wherein said drive cord means also extends from said slider means and about a sheave on the side frame opposite that having said first mentioned winch, and wherein said attachment includes a rigid cutting bar and against the surface of which said cutter blade bears to cut a web fed therebetween.

12. The web feeder attachment of claim 8 wherein said several means of said control means comprise switches.

13. The web feeder attachment of claim 12 wherein said control means includes a switch actuator operated by said motor and actuating said second switch means to terminate operation of said motor upon movement of said cutter wheel to the other stop position and to alter the direction of rotation of said means for changing the direction of rotation of said motor.

14. The web feeder attachment of claim 13 wherein said switch actuator has actuating surfaces thereon engageable with said second switch means to terminate operation of said motor and engageable with said double pole switch to alter the contacted pole of said double pole switch.

15. The web feeder attachment of claim 12 wherein said switch means for changing the direction of rotation of said motor is a double pole switch and wherein the poles of said switch are reversed to each cycle of operation.

* * * * *